United States Patent [19]

Musy

[11] 4,407,586

[45] Oct. 4, 1983

[54] THIN WRIST-WATCH

[75] Inventor: Jean-Pierre Musy, Bienne, Switzerland

[73] Assignee: Societe Suisse pour l'Industrie Horlogere Management Services S.A., Bienne, Switzerland

[21] Appl. No.: 181,928

[22] Filed: Aug. 27, 1980

[30] Foreign Application Priority Data

Sep. 4, 1979 [FR] France ..... 79 22607

[51] Int. Cl.[3] ..... G04B 19/20

[52] U.S. Cl. ..... 368/77; 368/88; 368/221; 368/233; 368/162

[58] Field of Search ..... 368/76, 77, 80, 88, 368/220, 221, 228, 233, 276, 281, 234, 155, 156, 160, 161, 162, 163; 310/40 MM, 184

[56] References Cited

U.S. PATENT DOCUMENTS

| | | | |
|---|---|---|---|
| 1,185,624 | 6/1916 | Boylen | 368/88 |
| 2,153,004 | 4/1939 | Rodanet | 368/221 |
| 2,852,908 | 9/1958 | Stern et al. | 368/77 |
| 3,175,112 | 3/1965 | Thoma . | |
| 3,538,703 | 11/1970 | Walton | 368/80 |
| 3,646,750 | 3/1972 | Reich | 368/163 |
| 3,893,288 | 7/1975 | Meitinger | 368/162 X |
| 3,952,499 | 4/1976 | Reisman . | |
| 4,029,980 | 6/1977 | Gamble . | |

FOREIGN PATENT DOCUMENTS

| | | | |
|---|---|---|---|
| 1018684 | 1/1953 | France | 368/234 |
| 428929 | 12/1948 | Italy . | |

*Primary Examiner*—B. A. Reynolds
*Assistant Examiner*—Philip H. Leung
*Attorney, Agent, or Firm*—Griffin, Branigan & Butler

[57] ABSTRACT

An electronic wrist-watch of greatly reduced thickness has extremely thin time indicating discs for which a special driving and guiding system is employed. Further, a single-phase motor is provided with at least two stator windings for reducing the watch's thickness. A watch case comprises an integral case band in order to assure greater rigidity of this thin watch structure.

7 Claims, 4 Drawing Figures

THIN WRIST-WATCH

BACKGROUND OF THE INVENTION

This invention has as its object to provide a wrist-watch of reduced thickness comprising a watch case, a crystal and a least two time indicating discs such discs coupled together by a gear train itself driven by an electric motor controlled by an electronic circuit.

A wrist-watch of this type has been described by the assignee in U.S. application No. 143,061 which claims a wrist-watch of reduced thickness comprising a case, a crystal and at least two time indicating discs coupled together through a gear train driven by an electric motor controlled by an electronic circuit wherein the overall thickness is constituted by superposition of the back of the case, the time indicating discs and a crystal, there being sufficient play arranged on all sides of said discs to permit free movement thereof, the remaining principal watch elements such as the motor, gear train and electronic circuit being located in portions of the case extending beyond the diameter of the indicating discs, said portions having a thickness no greater than the overall thickness.

The following description is based on the above-cited application and proposes various improvements thereto.

A continuing problem in this type of construction is that of obtaining the maximum possible reduction in thickness of the elements thereby to arrive at an ultra-thin wrist-watch. Such reduction however must not cause loss of solidity and performance and materials as well as constructional arrangements will be chosen to assure reliability of the mechanism.

The purpose of the invention is to provide means enabling a maximum overall reduction in the watch thickness.

This purpose is attained by use of the claimed arrangements.

DETAILED DESCRIPTION OF THE DRAWINGS

Figure 1:
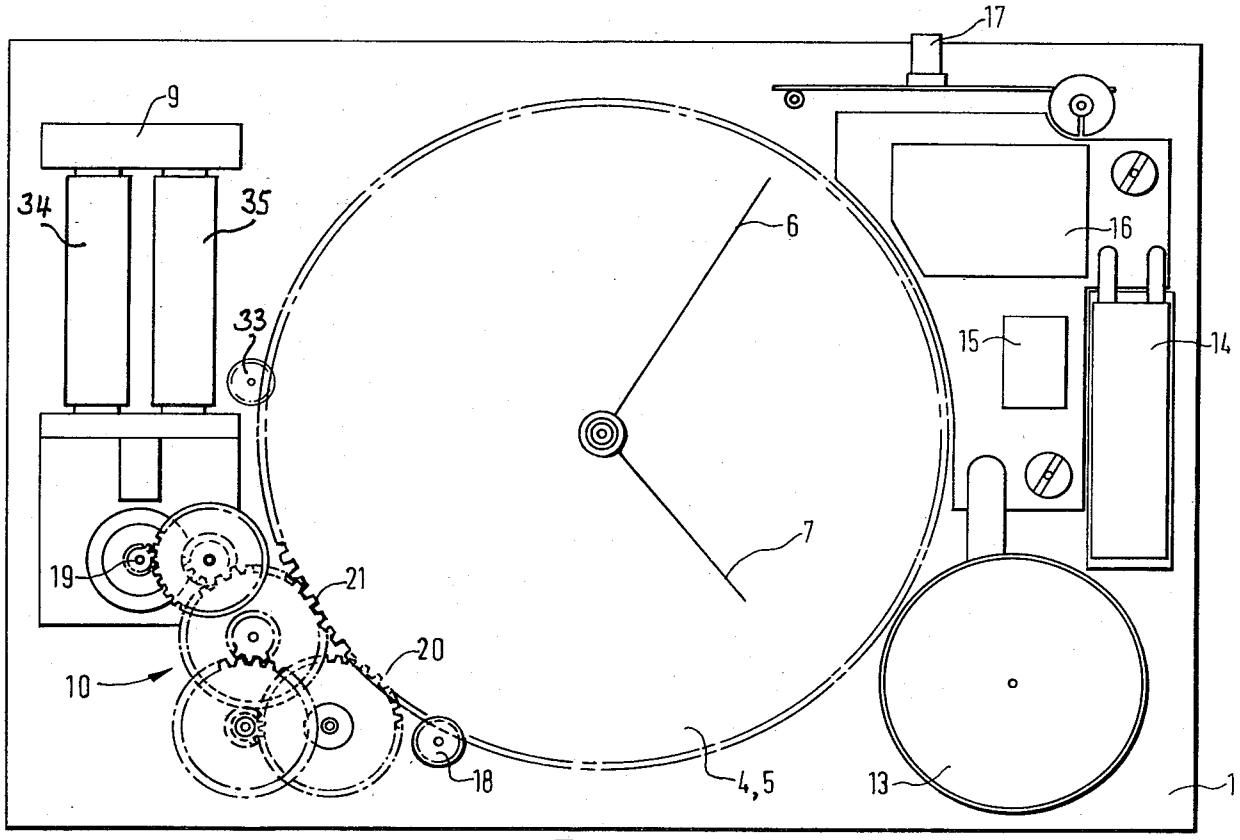
FIG. 1 is a plan view of the watch bottom plate to an enlarged scale.
Figure 2:
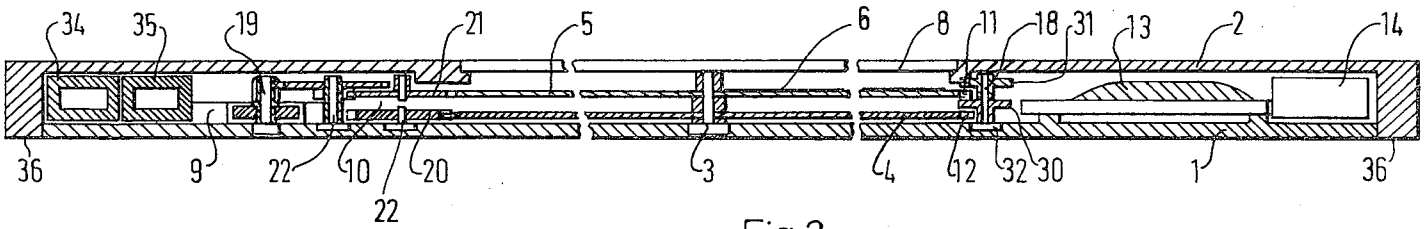
FIG. 2 is a cross sectional view to a still larger scale, the various elements being shown in a manner to facilitate understanding.

FIGS. 1 and 2 show clearly how the watch is arranged and in general constitute a reproduction of the characteristic elements described in the above-mentioned application. However, important improvements have been introduced and will be hereinafter described.

The first improvement concerns the indicator discs. A transparent hours indicator disc 4 and transparent minutes indicator disc 5 pivot around a first central stud 3. On each disc there is impressed a guide mark representing respectively an hours hand 7 and a minute hand 6. Since the thickness of these discs will constitute the greater part of the overall thickness of the watch it is of interest to reduce as much as possible such thickness. It should be chosen to be between 0.05 and 0.15 mm with a preferred value of about 0.1 mm. The discs are initially cut out in the form of a washer; thereafter peripheral teeth are cut therein. It is important to manufacture such discs from a stable material which exhibits very little deformation because of differences in temperature and humidity.

Figure 3B:
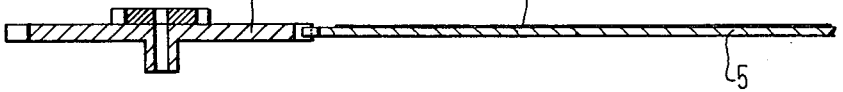
FIGS. 3*a* and 3*b* show a cross section of the driving system acting on the hours and minutes indicators respectively.
Figure 3A:
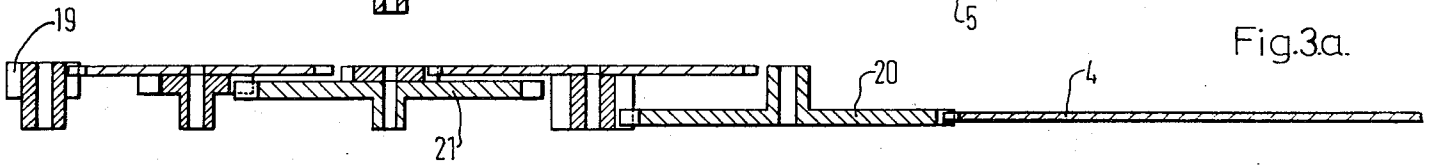

The second improvement concerns the driving of the indicator discs. FIG. 3*a* shows how the hours disc 4 may be driven from pinion 19 as fixed to the axis of motor 9 via the hour wheel 20. Incorporated into the gear train is also to be found a minutes wheel 21 which drives the minutes disc 5 as shown in FIG. 3*b*. As previously mentioned the indicator discs are very thin and because of this they are poorly adapted to transmit a torque. In Swiss Pat. No. 307 045 one may see in FIG. 3 that the hours disc 15 as driven by the barrel cover 11 drives through teeth 12 the minutes disc 21 by way of a gear train 24 to 28. The construction here proposed avoids the problem wherein one of the indicators is required to transmit its motion to the other indicator, since each of the said indicators are driven by separate and independent gear trains and this from a common driving wheel 21 as shown in FIGS. 3*a* and 3*b*.

The third improvement concerns guiding of the indicator discs. As already explained such discs are very thin. Therefore, it is necessary to foresee guide means situated proximate the drive wheels and which will maintain teeth of the drive wheels opposite the teeth of the discs. Such arrangement 18 is shown in FIGS. 1 and 2 and comprises a first roller 30 intended to guide the hours indicator 4 and second roller 31 intended to guide the minutes indicator 5. The rollers may be in two independent pieces, are superposed one over the other and may rotate freely about a stud 32 fixed to the case back 1. The arrangement of the guide rollers is such that if the hours indicator 4 is not entirely flat it will be supported on roller 30 to rotate the latter reducing thus the considerable friction loss which would result if the roller were fixed. In the same manner the minutes disc 5 may come into contact with roller 31. FIG. 1 shows a second guide arrangement 33 which may apply to the construction to assure a still better correspondence between the teeth. It will be understood that arrangements 18 and 33 are as shown in FIG. 1 that is to say proximate the drive wheels and that the arrangement of guide 18 of FIG. 2 does not really correspond to the construction utilized but has been shown thus for purposes of clarity in the drawings.

The fourth improvement concerns the electric motor. The single phase bipolar motor which drives the mechanism must exhibit a thickness as small as possible. This is difficult to realize using known motors which have only a single winding in the stator circuit. In order to limit this thickness the invention proposes the utilization of two windings 34, 35 such as shown in FIG. 1. A still greater reduction may be obtained in a variant of the invention where the number of the windings is increased to 4. In such case each motor pole includes two windings.

Finally the fifth improvement concerns the watch case. FIG. 2 shows the case back 1 of the watch which at the same time serves as the bottom plate on which are mounted all the mechanical and electrical components. The bottom plate is introduced into the case 2 which includes a case band 36 which is integral therewith and surrounds it entirely as well as a crystal 8. The purpose of this entire constuction being directed to reduction of the thickness of all portions to the extent that such may be possible the case back 1 and the case 2 may not be absolved from this rule. As a consequence there is a weakening of the structure and thereby an excessive vulnerability to shocks and strains which may arise. The case band 36 as described enables an increase in the rigidity to an important extent and provides to this extra flat watch all the reliability that one may expect from an ordinary watch.

What we claim is:

1. A wrist-watch of reduced thickness comprising a case, a crystal, at least two time indicating discs, a drive system arranged to drive said discs, said drive system itself being driven by an electric motor under control of an electronic circuit and wherein each of said indicator discs is formed from a single thin sheet of transparent material with teeth formed from this material on their periphery, said transparent material having a thickness between 0.05 mm and 0.15 mm, and each disc being driven from a common driving wheel which drives directly a first faster moving disc and indirectly a second slower moving disc via a gear train independent from the faster moving disc said discs being guided laterally at their periphery and proximate the driving point by at least one guide means including at least two coaxial independent idlers arranged to turn freely on a stud support on opposite sides of a disc said indicator discs being supported by a central axle stud for rotation thereabout.

2. Wrist-watch as set forth in claim 1 wherein a watch case member includes a case band over its entire periphery.

3. Wrist-watch as set forth in claim 1 wherein the faster moving disc displays minutes and the slower moving disc displays hours.

4. Wrist-watch as set forth in claim 1 including two guide means situated on both sides of and proximate to the driving point of the discs.

5. Wrist-watch as set forth in claim 1 wherein the electric motor is a single phase bipolar motor comprising a stator magnetic circuit having two windings positioned adjacent to one another.

6. Wrist-watch as set forth in claim 1 wherein the electric motor is a single phase bipolar motor comprising a stator magnetic circuit having four windings positioned adjacent to one another.

7. A wrist-watch of reduced thickness comprising a case, a crystal, at least two time indicating discs, a drive system arranged to drive said discs, said drive system itself being driven by an electric motor under control of an electronic circuit and wherein said indicating discs are formed from thin sheets of material with teeth provided on the periphery, said electric motor being a single phase bipolar motor comprising a stator magnetic circuit having at least two windings positioned adjacent to one another so that the wrist-watch can be made thinner than if one large winding were used.

* * * * *